US007207774B2

(12) United States Patent
Kashiwazaki et al.

(10) Patent No.: US 7,207,774 B2
(45) Date of Patent: Apr. 24, 2007

(54) CENTRIFUGAL FAN AND CASING THEREOF

(75) Inventors: Yoshio Kashiwazaki, Kiryu (JP); Youichi Nagata, Kiryu (JP)

(73) Assignee: Japan Servo Co., Ltd., Tokyo-to (JP)

( * ) Notice: Subject to any disclaimer, the term of this patent is extended or adjusted under 35 U.S.C. 154(b) by 149 days.

(21) Appl. No.: 11/078,593

(22) Filed: Mar. 14, 2005

(65) Prior Publication Data

US 2005/0207888 A1 Sep. 22, 2005

(30) Foreign Application Priority Data

Mar. 17, 2004 (JP) ..... 2004-076414
Mar. 31, 2004 (JP) ..... 2004-105664
Mar. 31, 2004 (JP) ..... 2004-105665
Mar. 31, 2004 (JP) ..... 2004-105666

(51) Int. Cl.
*F04D 29/40* (2006.01)

(52) U.S. Cl. ..... 415/206; 415/203

(58) Field of Classification Search ..... 415/185, 415/203, 204, 206, 224
See application file for complete search history.

(56) References Cited

U.S. PATENT DOCUMENTS 6,575,701 B2 * 6/2003 Kamiya et al. ..... 415/206
2005/0207888 A1 9/2005 Kashiwazaki et al.

FOREIGN PATENT DOCUMENTS

JP 7-46811 2/1995
JP 7-91400 4/1995
KR 2004016719 A * 2/2004

OTHER PUBLICATIONS

U.S. Appl. No. 11/339,610, filed Jan. 26, 2006, Kashiwazaki et al.
U.S. Appl. No. 11/339,611, filed Jan. 26, 2006, Senba.
U.S. Appl. No. 11/392,749, filed Mar. 30, 2006, Shimada.

* cited by examiner

*Primary Examiner*—Edward K. Look
*Assistant Examiner*—Dwayne J White
(74) *Attorney, Agent, or Firm*—Oblon, Spivak, McClelland, Maier & Neustadt, P.C.

(57) ABSTRACT

A centrifugal fan includes a scroll casing having an almost cylindrical shape. The casing consists of first and second casings. The first casing constitutes one base wall and a part of a side circumferential wall of a cylinder, and the second casing constitutes the other base wall and the remaining part of the side circumferential wall. An air inlet is formed on a center portion of the base wall of the first casing, and an exhaust port that is formed on the side circumferential wall. An impeller having many blades and a motor for driving the impeller are contained in the casing. A cylindrical partition that is formed on the inside of the base wall of the second casing over the entire circumference. The partition consists of a high partition formed in at least a region close to the exhaust port and a low partition formed in the other region.

14 Claims, 10 Drawing Sheets

CENTRIFUGAL FAN AND CASING THEREOF

BACKGROUND OF THE INVENTION

The present invention relates to a centrifugal fan that collects airflow taken in from a center axis of a motor by a scroll casing and discharges the airflow in a centrifugal direction. The present invention also relates to a casing of such a centrifugal fan.

Centrifugal fans, which use DC brushless motors especially, are widely used to cool electronic components of OA equipment such as a personal computer and a copying machine because they can not only make the motors compact and light in weight but also control air quantity easily due to easy control of the motor.

FIG. 12 is a front view of a conventional centrifugal fan viewing in the motor axis direction, FIG. 13 is a side view of FIG. 12 viewed from the side of an exhaust port, FIG. 14 is a sectional view of FIG. 12 along XIV—XIV line, and FIG. 15 is a front view of the centrifugal fan in FIG. 12 when one of two-part casings is removed.

The illustrated centrifugal fan 1 has a casing 10, an impeller 20 that is rotatabley mounted in the casing 10, and a motor 30 that rotates the impeller 20. A circular air inlet 11 is formed at the front of the casing 10 and a rectangular exhaust port 12 is formed at the side of the casing 10.

The casing 10 is constituted by combining resin made first and second casings 10*a* and 10*b* that are divided by a plane perpendicular to a rotating shaft 31 of the motor 30. The air inlet 11 is formed on the first casing 10*a*. As shown in FIG. 14, a bell mouth 13 is formed along the inner circumference of the air inlet 11. The bell mouth 13 is formed by bending a tip whose thickness is the same as the other portion of the casing 10 inside. As shown in FIG. 14, a cylindrical bearing box 15 made from metal is fixed to the second casing 10*b*. The bearing box 15 supports the rotating shaft 31 via bearings 14 in its inside. A stator 32 of the motor 30 is fixed to the outside of the bearing box 15. Further, a cylindrical partition 16 is formed inside the second casing 10*b* over 360 degrees. The diameter of the partition 16 is almost identical to that of the motor 30 and the height thereof is constant over all circumferences.

The motor 30 is an outer-rotor type DC blushless motor that consists of a stator 32 having a stator core 32*a* and coils 32*b* wound in slots of the stator core 32*a*, and a rotor 33 having a cup-shaped hub 33*a* fixed on the tip of the rotating shaft 31, a yoke 33*b* attached to inner circumferential surface of the hub 33*a*, and a permanent magnet 33*c* held by the yoke 33*b*. Further, a circuit board 34 on which a drive circuit to control power distribution to the coils 32*b* is contained is fixed to the bearing box 15 at the position between the second casing 10*b* and the stator 32.

The impeller 20 is formed as a single unit with the hub 33*a* of the rotor 33, and many blades 21 are arranged on an outer circumference of the impeller 20.

As shown in FIG. 15, the inner circumferential surface of the casing 10 is formed like a scroll and the width of an airflow path, which is formed between the inner circumferential surface of the casing 10 and the outer circumference of the impeller 20, in the radial direction gradually increases from a nose 12*a* of the exhaust port 12 as a starting point in the rotating direction of the impeller 20 shown by the arrow in the drawing.

When the centrifugal fan 1 is used, the impeller 20 rotates in the counterclockwise direction shown by the arrow, which discharges the air taken in from the air inlet 11 to the periphery by the centrifugal force. The air is collected by the inner circumferential surface of the casing 10, and is discharged from the exhaust port 12.

Incidentally, since the upstream side of the airflow path into which air flows is connected to the downstream side thereof from which air discharges in the above centrifugal fans 1, the discharge airflow becomes turbulent flow, which causes noise and loses discharge pressure.

Japanese Unexamined Patent Publication No. 7-091400 discloses a technique to form an auxiliary air inlet, which is connected to the most upstream portion of the airflow path, on the casing in order to prevent the turbulence of the discharge airflow. However, since the formation of the auxiliary air inlet requires a large change of the casing design, it becomes difficult to divert existing parts or the like.

The above-mentioned centrifugal fan 1 forms the partition 16 on the second casing 10*b* as shown in FIG. 14 to prevent such turbulence of the discharge airflow. When the partition 16 is formed at the position close to the inner edge of the impeller, the high-pressure air that must be discharged from the exhaust port 12 does not leaks to the low-pressure air at the most upstream side of the airflow path, which can prevent the turbulence of the discharge airflow.

However, since the partition 16 is formed so as to surround the circumference of the circuit board 34 as shown in FIG. 14, there arises a problem of disturbing the airflow to the circuit board 34 and disturbing heat radiation of the electronic circuit on the circuit board (the first problem).

On the other hand, Japanese Unexamined Patent Publication No. 7-46811 discloses a technique regarding heat radiation of an electronic circuit. The publication discloses the technique to provide a metal housing cover in addition to a casing and to contact a power element that generates the largest heat in the electronic circuit with the housing cover to radiate heat of the power element to the outside. However, the technique disclosed in the publication requires a new metal part that must be unified with the resin made casing, there is a problem of increasing manufacturing cost (the second problem).

Further, since the bell mouth 13, which forms the circumference of the air inlet 11, is formed so that its cross-sectional shape becomes an arc from the external surface and the tip side of the bell mouth 13 that faces to the blades 21 of the impeller 20 is formed in the shape of a cylinder in the above-mentioned conventional example, a whirlpool $S_1$, (see FIG. 14) occurs near the tip of a blade 21, which causes a problem of generating noise due to pulsation of airflow near the air inlet 11 (the third problem).

Furthermore, since the above-mentioned conventional example cannot radiate heat generated by the coils 32*b* of the stator 32 to the outside, the heat reaches the bearings 14 through the metal bearing box 15, which causes a problem of shortening the useful life of the bearings 14 (the fourth problem). This is ascribable to the following reasons. That is, since the head of the hub 33*a* has comparatively wide surface perpendicular to the rotating shaft 31 in the conventional centrifugal fan 1, the air taken into the air inlet 11 from the outside flows from only the periphery of the hub 33*a* as shows by the arrow $S_2$ in FIG. 14, and there is little airflow along the portion covering the coils 32*b*. Further, since the hub 33*a* is formed by resin molding together with the blades 21, it shows low thermal conductivity.

Furthermore, when the end portions of the exhaust port 12 that are connected to the inner circumferential surface of the casing 10 are flat at both the nose side and the anti-nose side as the above-mentioned conventional example, the discharge pressure is reduced in the exhaust port in the case of the short exhaust port especially, which arises a problem of reducing an air velocity and air quantity (the fifth problem).

SUMMARY OF THE INVENTION

The first purpose of the present invention is to solve the above-mentioned first and second problems by providing an improved centrifugal fan, which is capable of cooling electronic parts on a circuit board without increasing manufacturing cost on the precondition that the turbulence of the discharge airflow is prevented by the partition.

The second purpose of the present invention is to solve the above-mentioned third problem by providing an improved casing of a centrifugal fan, which is capable of preventing noise generated by pulsation of airflow near an air inlet.

The third purpose of the present invention is to solve the above-mentioned fourth problem by providing an improved centrifugal fan, which is capable of preventing overheat of a bearing due to heat generated by coils of a stator to extend useful life of the bearing.

The fourth purpose of the present invention is to solve the above-mentioned fifth problem by providing an improved casing of a centrifugal fan, which is capable of preventing the loss of the discharge pressure at the exhaust port to increase an air velocity and air quantity.

In order to accomplish the above-mentioned first purpose, a centrifugal fan of a first aspect according to the present invention includes:

a scroll casing that has an almost cylindrical shape including a first base wall, a second base wall, and a side circumferential wall, an air inlet that is opened in an axial direction being formed on a center portion of the first base wall, and an exhaust port that is opened in a circumferential direction being formed on one position of the side circumferential wall;

a motor that is attached to a center portion of the second base wall at the inside of the casing so that a rotating shaft of the motor is perpendicular to the second base wall;

a circuit board on which a control circuit for driving the motor is contained, the circuit board being supported at the position between the motor and the second base wall; and an impeller that is fixed to the rotating shaft, the impeller having many blades along the outer region thereof, wherein a cylindrical partition is formed on the inside of the second base wall over the entire circumference to jut toward the impeller, the partition consists of a high partition that has relatively large height in at least a region close to the exhaust port and a low partition that has relatively small height in the other region.

With the first aspect, a leakage from the high-pressure area at the side of the exhaust port to the low-pressure area at the upstream of the airflow path can be appropriately controlled, which reduces the discharge pressure loss due to the leakage, increasing a cooling effect for an electronic circuit arranged inside the partition.

In the first aspect, the high partition is preferably formed at least within a first quadrant in a two-dimensional rectangular coordinate system that is defined in a plane perpendicular to a rotation axis of the motor. The first quadrant is defined to contain the exhaust port. Second and fourth quadrants are located at both sides of the first quadrant, respectively. A third quadrant is symmetric to the first quadrant with respect to the origin that is an intersection of the plane and the rotation axis.

The high partition may be formed only in the first quadrant, or may be formed within a region of 270 degrees at the maximum including at least a portion of the second and fourth quadrants in addition to the first quadrant.

Further, the height of the low partition is preferably designed not to be larger than 0.8 when the height of the high partition is assumed as 1.0.

The connecting portion between the high partition and the low partition may be formed as a slope or a vertical step.

In order to accomplish the above-mentioned second purpose, a casing of a centrifugal fan of a second aspect according to the present invention includes:

a first base wall on which an air inlet that is opened in an axial direction is formed at the center thereof;

a second base wall to which a motor that drives an impeller is fixed at the center thereof; and a side circumferential wall on which an exhaust port that is opened in a circumferential direction is formed at one portion, the side circumferential wall being formed so that the radius thereof gradually increases from an upstream to a downstream, wherein a bell mouth is formed along the edge of the air inlet so as to jut toward the second base wall in the axial direction, and the bell mouth is formed so that the inner diameter of the bell mouth gradually decreases in the axial direction from the outer surface of the casing to the middle portion of the bell mouth and gradually increases from the middle portion to the tip of the bell mouth.

With the second aspect, the noise due to pulsation of airflow near the air inlet can be prevented.

In the second aspect, the cross section of the inner circumferential surface of the bell mouth maybe a semicircular arc, a combination of a small arc and a large arc that are connected, or a combination of an arc and a straight line that are connected. In the first combination, the cross section from the outer surface of the casing to the middle portion of the bell mouth may be the small arc having relatively small diameter, and the cross section from the middle portion to the tip of the bell mouth may be the large arc having relatively large diameter. In the second combination, the cross section from the outer surface of the casing to the middle portion of the bell mouth may be the arc, and the cross section from the middle portion to the tip of the bell mouth may be the straight line.

In order to accomplish the above-mentioned third purpose, a centrifugal fan of a third aspect according to the present invention includes:

a scroll casing that has an almost cylindrical shape including a first base wall, a second base wall, and a side circumferential wall, an air inlet that is opened in an axial direction being formed on a center portion of the first base wall, and an exhaust port that is opened in a circumferential direction being formed on one position of the side circumferential wall;

an outer-rotor type motor that is attached to a center portion of the second base wall at the inside of the casing so that a rotating shaft of the motor is perpendicular to the second base wall; and a hub that is fixed to the rotating shaft, the hub holding a rotor of the motor and an impeller having many blades along the outer region thereof, wherein the hub is formed from high heat-conductivity material, and the hub has a tapered head so that a portion covering the motor becomes narrow toward the air inlet to have a curved cross section.

With the third aspect, since the hub is made from high heat-conductivity material, heat generated at the coils can be radiated through the hub, and since the air flows along the tapered head covering the motor, the head radiation effect can be increased. This prevents overheat of the bearing, which can extend the useful life of the bearing.

In addition, when the casing is made from resin and has a molded-in bearing box to which a bearing that supports the rotating shaft is fixed, the bearing box has an adiabatic effect, which can reduce the heat transfer from the coils to the bearing in comparison with the case using a metal bearing box.

In order to accomplish the above-mentioned fourth purpose, a casing of a centrifugal fan of a fourth aspect according to the present invention includes:

a first base wall on which an air inlet that is opened in an axial direction is formed at the center thereof;

a second base wall to which a motor that drives an impeller is fixed at the center thereof; and a side circumferential wall on which an exhaust port that is opened in a circumferential direction is formed at one portion, the side circumferential wall being formed so that the radius thereof gradually increases from an upstream to a downstream, wherein the exhaust port has a tongue at a nose side that juts toward an anti-nose side, and the tongue has a curved surface in a direction of the discharge airflow so that the cross-sectional area of the exhaust port becomes wider toward the edge thereof.

With the fourth aspect, the loss of the discharge pressure at the exhaust port can be prevented, which increases air velocity and air quantity.

In the fourth aspect, the curved surface of the tongue is preferably formed so that an opening angle of a straight line that contacts the outer circumference of the impeller at the most downstream portion and intersects the curved surface with respect to an inner surface of the exhaust port at the anti-nose side falls in a range from 24 degrees to 33 degrees.

DESCRIPTION OF THE PREFERRED EMBODIMENTS

Hereinafter, embodiments of the present invention will be described with reference to the drawings. An outward appearance and a general inside construction of a centrifugal fan according to each embodiment are identical to those of the conventional example shown in FIG. 12 through FIG. 15. Therefore, an element identical to that in the conventional example will be described with a reference number identical to that in the conventional example.

First Embodiment

Figure 1:
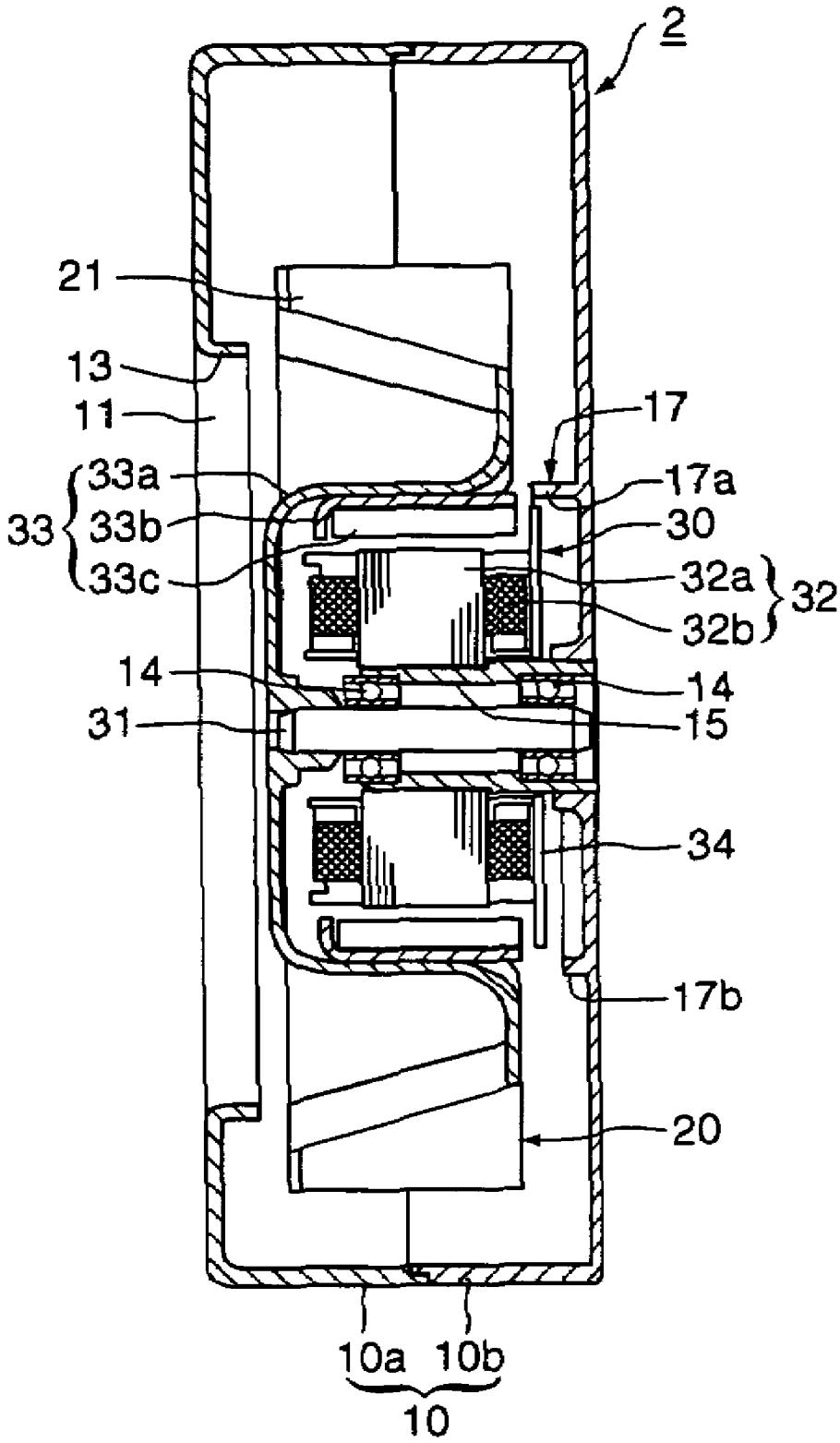
FIG. 1 is a sectional view showing a construction of a centrifugal fan according to a first embodiment of the present invention.
Figure 2:
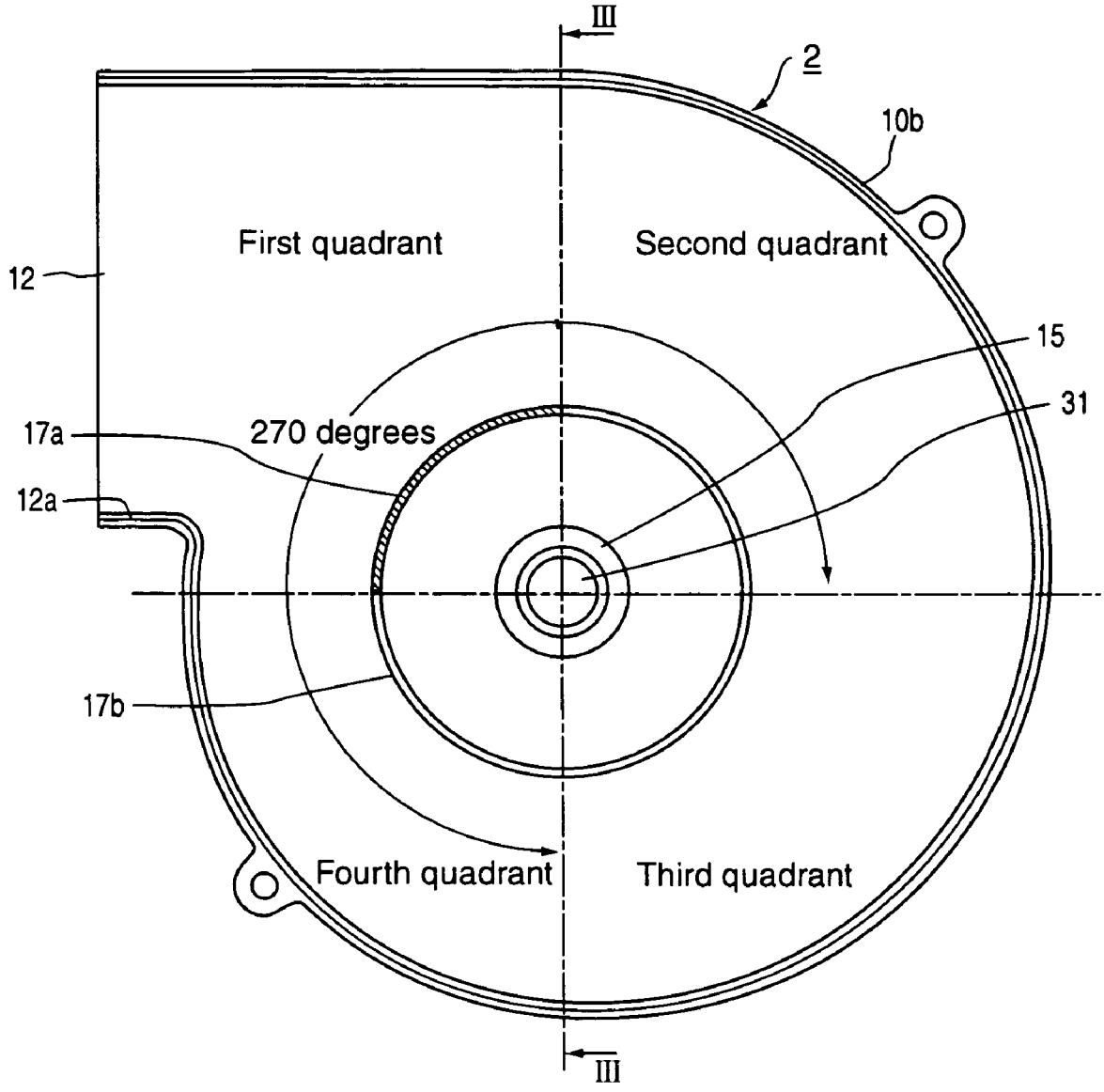
FIG. 2 is a front view showing a second casing of the centrifugal fan shown in FIG. 1.
Figure 3:
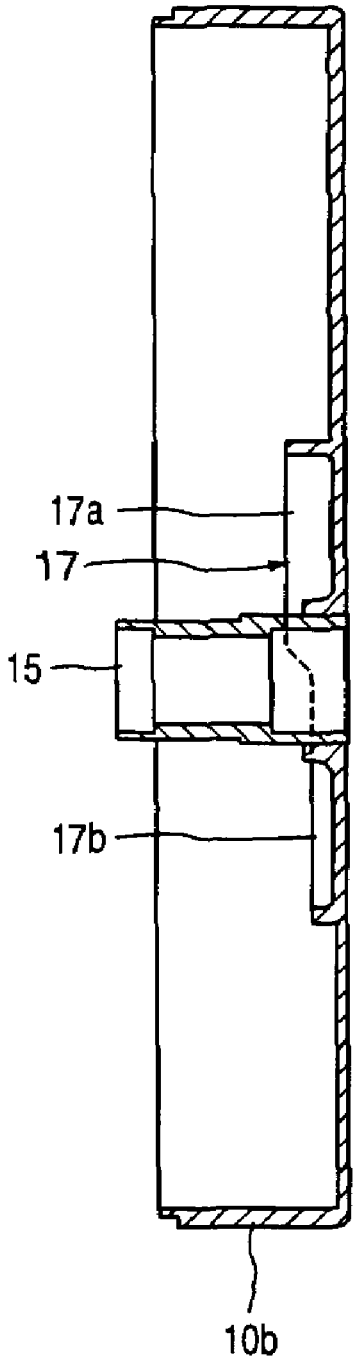
FIG. 3 is a sectional view of FIG. 2 along a III—III line.

FIG. 1 is a sectional view showing a construction of a centrifugal fan according to a first embodiment of the present invention, FIG. 2 is a front view showing a second casing of the centrifugal fan shown in FIG. 1, and FIG. 3 is a sectional view of FIG. 2 along a III—III line. The first embodiment corresponds to the above-mentioned first aspect of the present invention.

Figure 12:
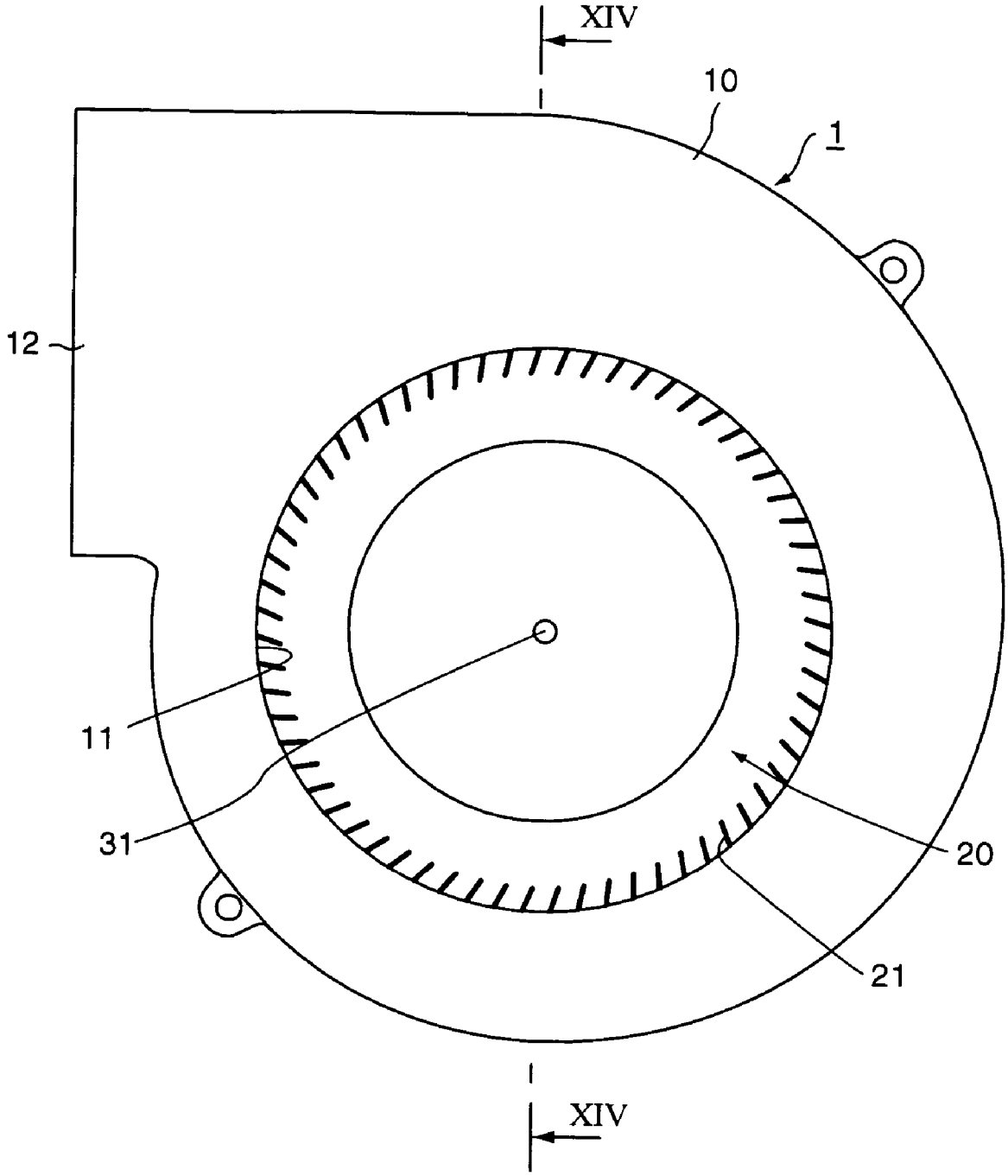
PRIOR ART FIG. 12
FIG. 12 is a front view of a conventional centrifugal fan viewing in the motor axis direction.
Figure 13:
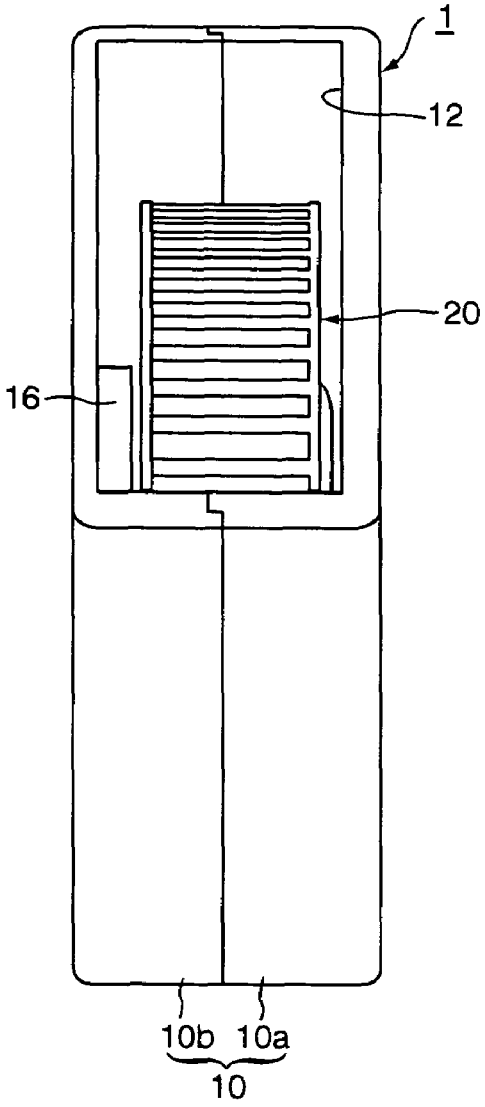
PRIOR ART FIG. 13
FIG. 13 is a side view of FIG. 12 viewed from the side of an exhaust port.

A centrifugal fan 2 of the first embodiment is provided with a scroll casing 10 having an almost cylindrical shape in the same manner as the conventional example shown in FIG. 12 and FIG. 13. The resin made casing 10 consists of a first casing 10*a* and a second casing 10*b*. The first casing 10*a* constitutes one base wall and a part of a side circumferential wall of a cylinder, and the second casing 10*b* constitutes the other base wall and the remaining part of the side circumferential wall. An air inlet 11 that is opened in an axial direction is formed on a center portion of the base wall portion of the first casing 10*a*, and an exhaust port 12 that is opened in a circumferential direction is formed on one position of the side circumferential wall (see FIG. 2).

An impeller 20 having many blades 21 along the outer region thereof is rotatably mounted inside the casing 10. The inner circumferential surface of the casing is formed like a scroll and the width of an airflow path, which is formed between the inner circumferential surface of the casing 10 and the outer circumference of the impeller 20, in the radial direction gradually increases from a nose 12*a* of the exhaust port 12 as a starting point in the rotating direction of the impeller 20 (the counterclockwise direction in FIG. 2).

A motor 30 that drives to rotate the impeller 20 is attached to a metal made bearing box 15 that is fixed to the center portion of the base wall of the second casing 10*b*. A rotating shaft 31 of the motor 30 is perpendicular to the base walls.

The rotating shaft 31 of the motor 30 is rotatably supported by bearings 14 arranged in the bearing box 15. The motor 30 is a DC brushless motor of an outer-rotor type and it consists of a stator 32 and a rotor 33. The stator 32 includes a stator core 32*a* and coils 33*b* that are wound around slots of the stator core 32*a*. The stator 32 is fixed around the bearing box 15. The rotor 33 has a cup-shaped hub 33*a* fixed to the tip of the rotating shaft 31, a yoke 33*b* attached to the inner circumferential surface of the hub 33*a*, and a permanent magnet 33*c* supported by the yoke 33*b*.

Further, the impeller 20 and the hub 33*a* of the rotor 33 are molded in one piece from resin. In addition, a circuit board 34 on which a drive circuit to control power distribution to the coils 32*b* is contained is fixed to the bearing box 15 at the position between the second casing 10*b* and the stator 32.

A bell mouth 13 is formed along the inner circumference of the air inlet 11. The bell mouth 13 is formed by bending a tip whose thickness is the same as the other portion of the casing 10 inside.

The centrifugal fan 2 of the first embodiment has a cylindrical partition 17 that is formed on the inside of the base wall of the second casing 10*b* over the entire circumference. The partition 17 juts toward the impeller 20 so as to close to the inner circumferential edge of the impeller 20. The partition 17 consists of a high partition 17*a* that has relatively large height in at least a region close to the exhaust port 12 and a low partition 17*b* that has relatively small height in the other region.

As shown in FIG. 2, a two-dimensional rectangular coordinate system is defined in a plane perpendicular to a rotation axis of the motor 30. The origin of the coordinate system is an intersection of the plane and the rotation axis. A first quadrant is defined to contain the exhaust port 12. Second and fourth quadrants are defined to be located at both sides of the first quadrant, respectively. A third quadrant is symmetric to the first quadrant with respect to the origin. In the first embodiment, the high partition 17*a* (indicated by hutching in FIG. 2) is formed in the first quadrant and the low partition 17*b* is formed in the other quadrants (in the second, third, and fourth quadrants). However, the high partition 17*a* may be formed within a region of 270 degrees at the maximum including at least a portion of the second and fourth quadrants in addition to the first quadrant.

The height of the low partition 17*b* is designed not to be larger than 0.8 when the height of the high partition 17*a* is assumed as 1.0. Further, the connecting portion between the high partition 17*a* and the low partition 17*b* is formed as a slope shown by a dotted line in FIG. 3 in the first embodiment.

When the centrifugal fan 2 is used, the impeller 20 rotates in the counterclockwise direction in FIG. 2, which discharges the air taken in from the air inlet 11 to the periphery by the centrifugal force. The air is collected by the inner circumferential surface of the casing 10, and is discharged from the exhaust port 12.

Further, the partition 17 can reduce turbulence of the discharge airflow due to the connection between the upstream side of the airflow path into which air flows and the downstream side thereof from which air discharges. However, if the high partition 17*a* is formed around the entire circumference, it is difficult to cool the electronic elements on the circuit board 34. According to the first embodiment, the high partition 17*a* formed in the region close to the exhaust port 12 can reduce the turbulence of the discharge airflow and the low partition 17*b* allows the airflow to the circuit board 34, which can cool the electronic elements.

Second Embodiment

Figure 4:
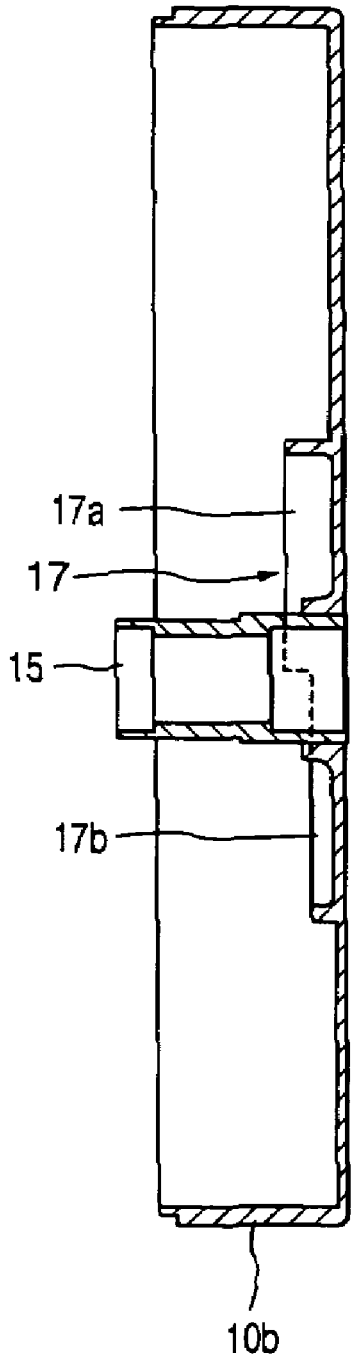
FIG. 4 is a sectional view showing a second casing of a centrifugal fan according to a second embodiment in the same manner as FIG. 3.

FIG. 4 is a sectional view showing a second casing of a centrifugal fan according to a second embodiment in the same manner as FIG. 3. The second embodiment corresponds to the above-mentioned first aspect of the present invention.

The entire configuration of a centrifugal fan of the second embodiment is the same as that of the first embodiment. In the second embodiment, the partition 17 is also formed on the inside of the base wall of the second casing 10*b* over the entire circumference. The partition 17 juts toward the impeller so as to close to the inner circumferential edge of the impeller. The partition 17 consists of the high partition 17*a* that has relatively large height in at least a region close to the exhaust port 12 and the low partition 17*b* that has relatively small height in the other region.

The connecting portion between the high partition 17*a* and the low partition 17*b* is formed as a vertical step shown by a dotted line in FIG. 4 in the second embodiment.

Third Embodiment

Figure 5:
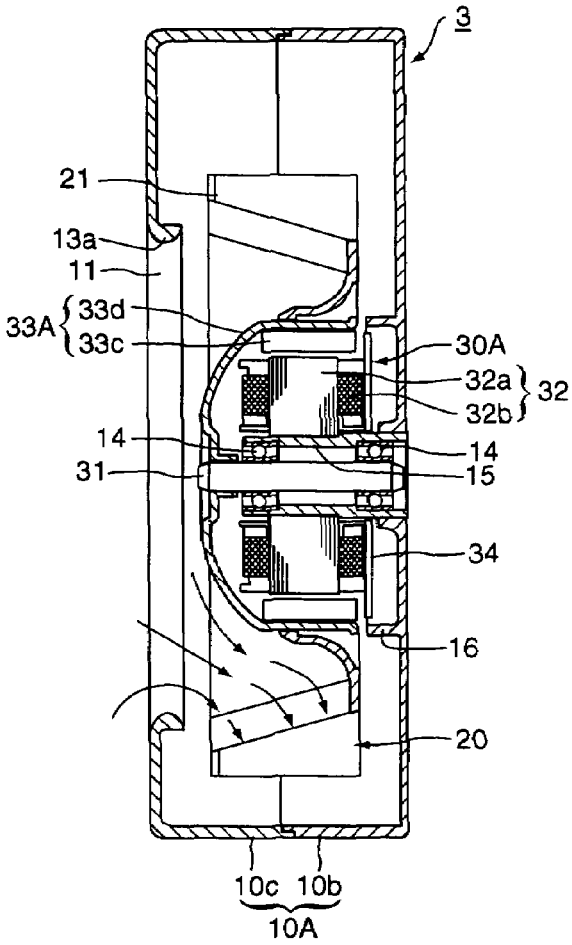
FIG. 5 is a sectional view showing a construction of a centrifugal fan according to a third embodiment of the present invention.

FIG. 5 is a sectional view showing a construction of a centrifugal fan according to a third embodiment of the present invention. The third embodiment corresponds to the above-mentioned second and third aspects of the present invention.

A centrifugal fan 3 of the third embodiment is provided with a scroll casing 10A having an almost cylindrical shape in the same manner as the first embodiment. The resin made casing 10A consists of a first casing 10*c* and a second casing 10*b*. The first casing 10*c* constitutes one base wall and a part of a side circumferential wall of a cylinder, and the second casing 10*b* constitutes the other base wall and the remaining part of the side circumferential wall. An air inlet 11 that is opened in an axial direction is formed on a center portion of the base wall portion of the first casing 10*c*, and an exhaust port 12 that is opened in a circumferential direction is formed on one position of the side circumferential wall in the same manner as that shown in FIG. 2.

An impeller 20 having many blades 21 along the outer region thereof is rotatably mounted inside the casing 10A. The inner circumferential surface of the casing 10A is formed like a scroll and the width of an airflow path, which is formed between the inner circumferential surface of the casing 10A and the outer circumference of the impeller 20, in the radial direction gradually increases from a nose of the exhaust port as a starting point in the rotating direction of the impeller.

A motor 30A that drives to rotate the impeller 20 is attached to a metal made bearing box 15 that is fixed to the center portion of the base wall of the second casing 10*b*. A rotating shaft 31 of the motor 30A is perpendicular to the base walls.

The rotating shaft 31 of the motor 30A is rotatably supported by bearings 14 arranged in the bearing box 15. The motor 30A is a DC brushless motor of an outer-rotor type and it consists of a stator 32 and a rotor 33A. The stator 32 includes a stator core 32*a* and coils 32*b* that are wound around slots of the stator core 32*a*. The stator 32 is fixed around the bearing box 15. The rotor 33A has a cup-shaped hub 33*d* fixed to the tip of the rotating shaft 31 and a permanent magnet 33*c* attached to the inside of the hub 33*d*.

The hub 33*d* is formed from high heat-conductivity material such as metal, and the hub 33*d* has a tapered head so that a portion covering the motor 30A becomes narrow toward the air inlet 11 to have a curved cross section. The impeller 20 is attached around the hub 33*d*. In addition, a circuit board 34 on which a drive circuit to control power distribution to the coils 32*b* is contained is fixed to the bearing box 15 at the position between the second casing 10*b* and the stator 32. Further, a cylindrical partition 16 is formed inside the second casing 10*b* over 360 degrees. The diameter of the partition 16 is almost identical to that of the motor 30A and the height thereof is constant over all circumferences.

A bell mouth 13*a* is formed along the edge of the air inlet 11 so as to jut toward the second casing 10*b* in the axial direction. The bell mouth 13*a* is formed so that the inner diameter of the bell mouth 13*a* gradually decreases in the axial direction from the outer surface of the casing 10A to the middle portion of the bell mouth 13*a* and gradually increases from the middle portion to the tip of the bell mouth 13*a*. Specifically, the cross section of the inner circumferential surface of the bell mouth 13*a* is a semicircular arc in the third embodiment.

At the time of use, the impeller 20 rotates in the counterclockwise direction in FIG. 2, which discharges the air taken in from the air inlet 11 to the periphery by the centrifugal force. The air is collected by the inner circumferential surface of the casing 10A, and is discharged from the exhaust port 12.

According to the third embodiment, since the hub 33*d* is made from high heat-conductivity material, heat generated at the coils 32*b* can be radiated through the hub 33*d*, and since the air flows along the tapered head of the hub 33*d* covering the motor 30A, the head radiation effect can be increased. This prevents overheat of the bearings 14, which can extend the useful life of the bearings 14.

Moreover, since the cross section of the inner circumferential surface of the bell mouth 13*a* is a semicircular arc, the airflow from the air inlet 11 of the casing 10A includes a flow along the semicircular arc surface from the outside of the bell mouth 13*a* to its inside as shown by the arrow in FIG. 5. Therefore, the air is taken in from entire area of the blades 21 of the impeller 20, which can reduce the occasion of a whirlpool and can prevent the generation of noise.

Fourth Embodiment

Figure 6:
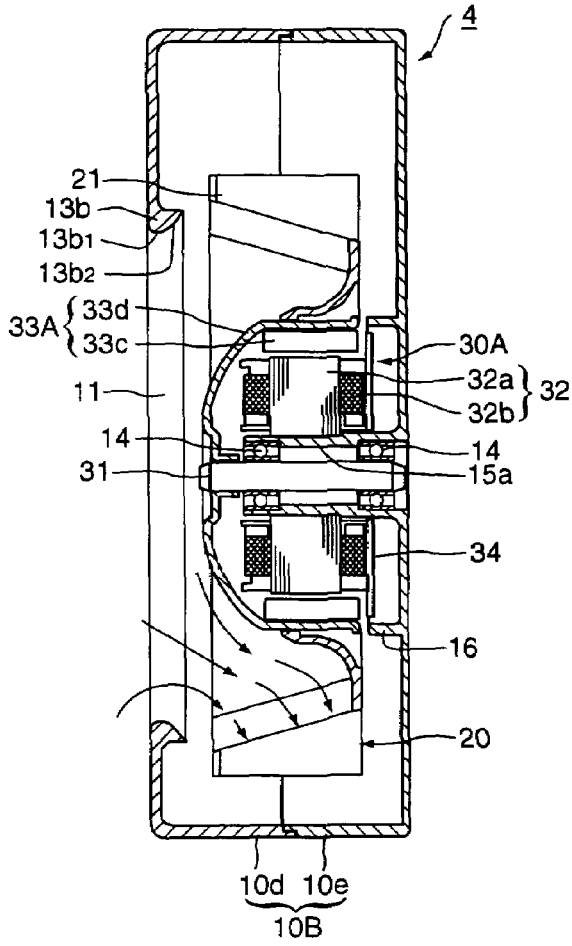
FIG. 6 is a sectional view showing a construction of a centrifugal fan according to a fourth embodiment of the present invention.

FIG. 6 is a sectional view showing a construction of a centrifugal fan according to a fourth embodiment of the present invention. The fourth embodiment corresponds to the above-mentioned second and third aspects of the present invention.

A centrifugal fan 4 of the fourth embodiment is provided with a scroll casing 10B having an almost cylindrical shape in the same manner as the first embodiment. The resin made casing 10B consists of a first casing 10*d* and a second casing 10*e*. The first casing 10*d* constitutes one base wall and a part of a side circumferential wall of a cylinder, and the second casing 10*e* constitutes the other base wall and the remaining part of the side circumferential wall. An air inlet 11 that is opened in an axial direction is formed on a center portion of the base wall portion of the first casing 10*d*, and an exhaust port 12 that is opened in a circumferential direction is formed on one position of the side circumferential wall in the same manner as that shown in FIG. 2.

The constructions of the impeller 20 and the motor 30A that are contained inside the casing 10B are identical to those of the third embodiment. However, unlike the third embodiment, the second casing 10*e* has the molded-in bearing box 15*a* utilized in the fourth embodiment. That is, the bearing box 15*a* and the second casing 10*e* are molded in one piece from resin.

Further, a bell mouth 13*b* is formed along the edge of the air inlet 11 so as to jut toward the second casing 10*e* in the axial direction. The bell mouth 13*b* is formed so that the inner diameter of the bell mouth 13*b* gradually decreases in the axial direction from the outer surface of the casing 10B to the middle portion of the bell mouth 13*b* and gradually increases from the middle portion to the tip of the bell mouth 13*b*. Specifically, in the fourth embodiment, the cross section of the inner circumferential surface of the bell mouth 13*b* is a combination of a small arc $\mathbf{13}b_1$ and a large arc $\mathbf{13}b_2$ that are connected to each other. That is, the cross section from the outer surface of the casing 10B to the middle portion of the bell mouth 13*b* is the small arc $\mathbf{13}b_1$ having relatively small diameter, and the cross section from the middle portion to the tip of the bell mouth 13*b* is the large arc $\mathbf{13}b_2$ having relatively large diameter.

According to the fourth embodiment, the resin made bearing box 15*a* has an adiabatic effect to reduce the heat transfer from the motor 30A to the bearings 14 in addition to the heat radiation effect of the hub 33*d* as with the third embodiment. This can further extend the useful life of the bearings 14.

Further, since the cross section of the inner circumferential surface of the bell mouth 13*b* is the combination of the small and large arcs, the airflow from the air inlet 11 of the casing 10B includes a flow along the combined arc surface from the outside of the bell mouth 13*b* to its inside as shown by the arrow in FIG. 6. Therefore, the air is taken in from entire area of the blades 21 of the impeller 20, which can reduce the occasion of a whirlpool and can prevent the generation of noise.

Fifth Embodiment

Figure 7:
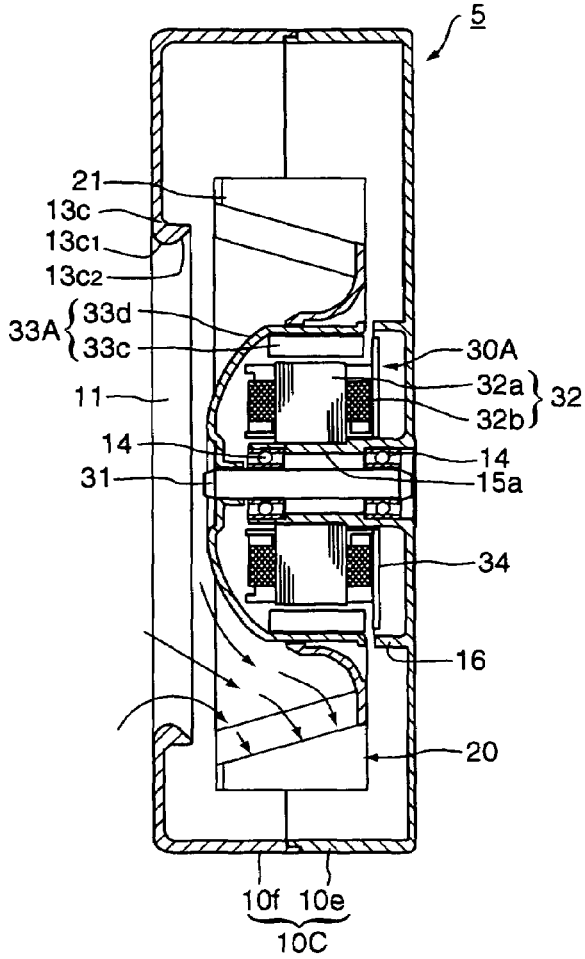
FIG. 7 is a sectional view showing a construction of a centrifugal fan according to a fifth embodiment of the present invention.

FIG. 7 is a sectional view showing a construction of a centrifugal fan according to a fifth embodiment of the present invention. The fifth embodiment corresponds to the above-mentioned second and third aspects of the present invention.

A centrifugal fan 5 of the fifth embodiment is provided with a scroll casing 10C having an almost cylindrical shape in the same manner as the first embodiment. The resin made casing 10C consists of a first casing 10*f* and a second casing 10*e*. The first casing 10*f* constitutes one base wall and a part of a side circumferential wall of a cylinder, and the second casing 10*e* constitutes the other base wall and the remaining part of the side circumferential wall. An air inlet 11 that is opened in an axial direction is formed on a center portion of the base wall portion of the first casing 10*f*, and an exhaust port 12 that is opened in a circumferential direction is formed on one position of the side circumferential wall in the same manner as that shown in FIG. 2.

The construction of the impeller 20 and the motor 30A that is contained inside the casing 10C is identical to that of the third embodiment. Further, the second casing 10*e* has the molded-in bearing box 15*a* in the same manner as the fourth embodiment.

Further, a bell mouth 13*c* is formed along the edge of the air inlet 11 so as to jut toward the second casing 10*e* in the axial direction. The bell mouth 13*c* is formed so that the inner diameter of the bell mouth 13*c* gradually decreases in the axial direction from the outer surface of the casing 10C to the middle portion of the bell mouth 13*c* and gradually increases from the middle portion to the tip of the bell mouth 13*c*. Specifically, in the fifth embodiment, the cross section of the inner circumferential surface of the bell mouth 13*c* is a combination of an arc $\mathbf{13}c_1$ and a straight line $\mathbf{13}c_2$ that are connected to each other. That is, the cross section from the outer surface of the casing 10C to the middle portion of the bell mouth 13*c* is the arc $\mathbf{13}c_1$, and the cross section from the middle portion to the tip of the bell mouth 13*c* is the straight line $\mathbf{13}c_2$.

According to the fifth embodiment, the resin made bearing box 15*a* has an adiabatic effect to reduce the heat transfer from the motor 30A to the bearings 14 in addition to the heat radiation effect of the hub 33*d* as with the fourth embodiment. This can further extend the useful life of the bearings 14.

Further, since the cross section of the inner circumferential surface of the bell mouth 13*c* is the combination of the arc and the straight line, the airflow from the air inlet 11 of the casing 10C includes a flow along the combined surface from the outside of the bell mouth 13*c* to its inside as shown by the arrow in FIG. 7. Therefore, the air is taken in from entire area of the blades 21 of the impeller 20, which can reduce the occasion of a whirlpool and can prevent the generation of noise.

Figure 8:
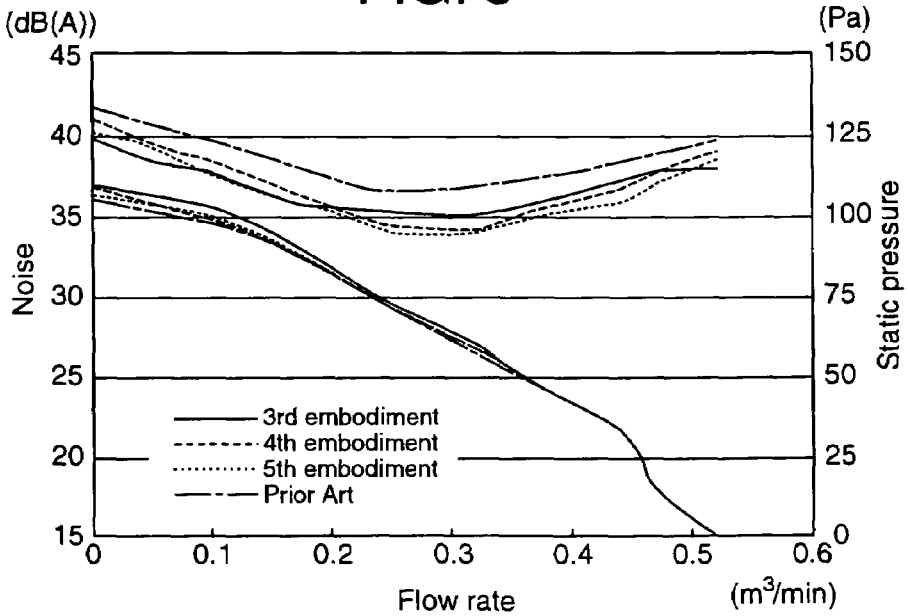
FIG. 8 is a graph that compares the performances of the third through fifth embodiments and the conventional example.
Figure 14:
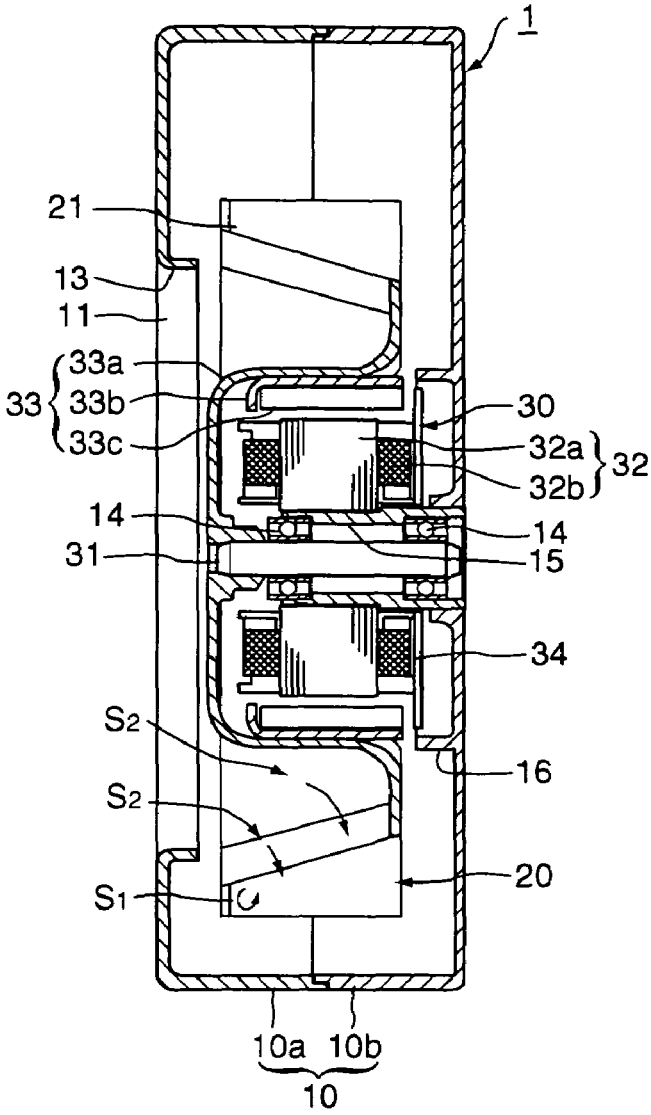
PRIOR ART FIG. 14
FIG. 14 is a sectional view of FIG. 12 along XIV—XIV line.

FIG. 8 is a graph that shows the performances of the third through fifth embodiments as compared with the conventional example whose bell mouth is formed as shown in FIG. 14. The horizontal axis designates air quantity, the left vertical axis designates noise, and the right vertical axis designates static pressure. The upper four curves in the graph represent the quantity-noise characteristics of the third embodiment (a solid line), the fourth embodiment (a long dotted line), the fifth embodiment (a short dotted line), and the conventional example (a dashed dotted line), respectively. The lower four curves represent the quantity-pressure characteristics in the same manner. The graph shows that the third through fifth embodiments can reduce the noise as compared with the conventional example with maintaining the same air quantity characteristics as the conventional example.

Sixth Embodiment

Figure 9:
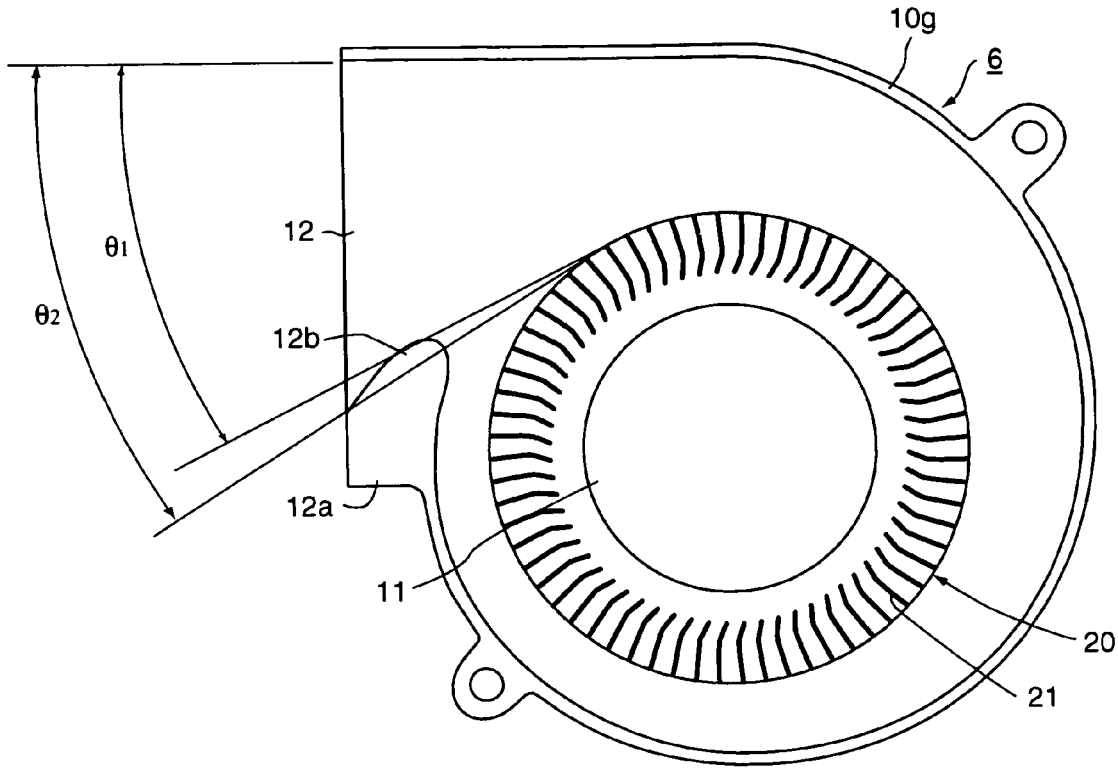
FIG. 9 is a front view showing an inside of a centrifugal fan according to a sixth embodiment of the present invention.

FIG. 9 is a front view showing an inside of a centrifugal fan according to a sixth embodiment of the present invention. The sixth embodiment corresponds to the above-mentioned fourth aspect of the present invention.

The centrifugal fan 6 of the sixth embodiment is provided with a scroll casing having an almost cylindrical shape in the same manner as the first embodiment. The resin made casing consists of a first casing (not shown) and a second casing 10*g*. The first casing constitutes one base wall and a part of a side circumferential wall of a cylinder, and the second casing 10*g* constitutes the other base wall and the remaining part of the side circumferential wall. An air inlet 11 that is opened in an axial direction is formed on a center portion of the base wall portion of the first casing, and an exhaust port 12 that is opened in a circumferential direction is formed on one position of the side circumferential wall.

An impeller 20 having many blades 21 along the outer region thereof and a motor (not shown) for driving to rotate the impeller are mounted on the second casing 10*g*. The inner circumferential surface of the casing is formed like a scroll and the width of an airflow path, which is formed between the inner circumferential surface of the casing and the outer circumference of the impeller 20, in the radial direction gradually increases from a nose 12*a* of the exhaust port 12 as a starting point in the rotating direction of the impeller 20 (the counterclockwise direction in FIG. 9).

In the sixth embodiment, the exhaust port 12 has a tongue 12*b* at the side of the nose 12*a* that juts toward an anti-nose side. The tongue 12*b* has a curved surface in a direction of the discharge airflow so that the cross-sectional area of the exhaust port 12 becomes wider toward the edge thereof.

At the time of use, the impeller 20 rotates in the counterclockwise direction in FIG. 9, which discharges the air taken in from the air inlet 11 to the periphery by the centrifugal force. The air is collected by the inner circumferential surface of the casing, and is discharged from the exhaust port 12.

The maximum static pressure of a centrifugal fan is determined by the distance from the center of the impeller 20 to the tongue 12*b*, and the maximum air quantity is determined by the cross-section area of the exhaust port 12. Therefore, the tongue 12*b* is formed at the position where the static pressure becomes high, and the tongue 12*b* has the curved surface whose section is an arc so that the cross-sectional area of the exhaust port 12 becomes wider toward the edge thereof.

The curved surface of the tongue 12*b* is formed so that an opening angle of a straight line that contacts the outer circumference of the impeller 20 at the most downstream portion and intersects the curved surface with respect to an inner surface of the exhaust port 12 at the anti-nose side falls in a range from $\theta_1$=24 degrees to $\theta_2$=33 degrees. This can maintain a balance between the air quantity and the static pressure.

According to the sixth embodiment, the loss of the discharge pressure at the exhaust port 12 can be prevented, which increases both of the air quantity and the static pressure.

Figure 10:
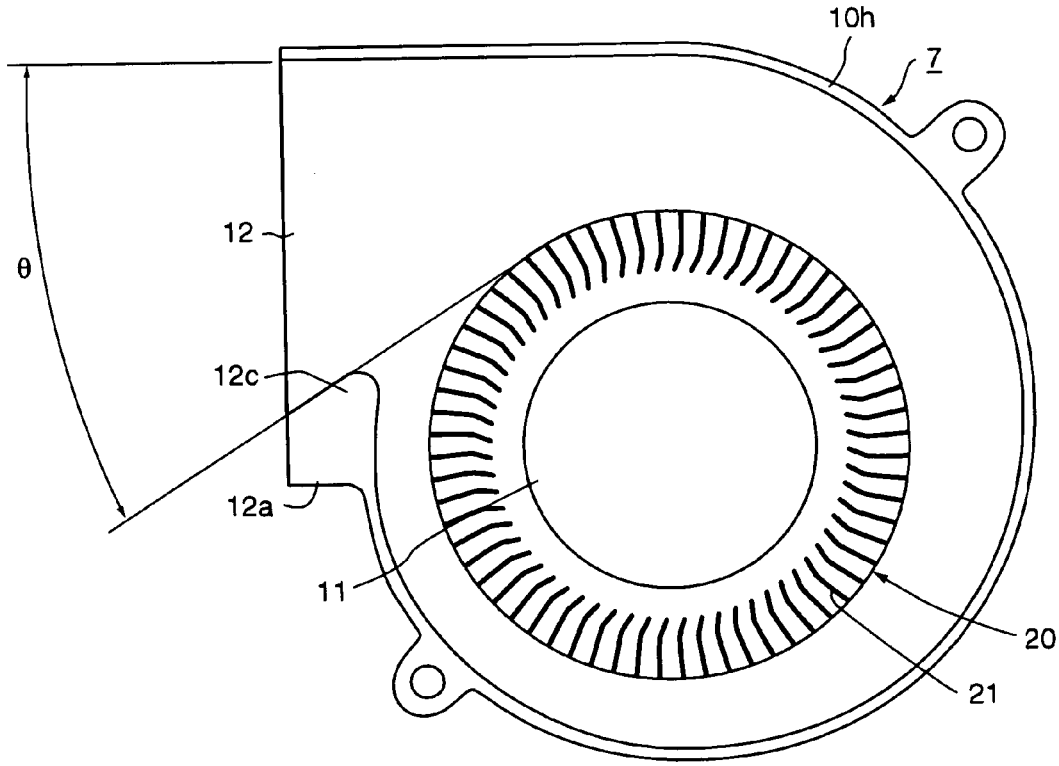
FIG. 10 is a front view showing an inside of a centrifugal fan according to a comparative example that is an improvement of the conventional example.

FIG. 10 is a front view showing a construction of a comparative example. A centrifugal fan 7 of the comparative example is provided with a first casing (not shown) and a second casing 10*h* in the same manner as the sixth embodiment. The first casing constitutes one base wall and a part of a side circumferential wall of a cylinder, and the second casing 10*h* constitutes the other base wall and the remaining part of the side circumferential wall. A tongue 12*c* is formed on the exhaust port 12 at the side of the nose 12*a*. The tongue 12*c* has a flat surface at the side of the edge of the exhaust port 12*a* so that the cross-sectional area of the exhaust port 12 becomes wider toward the edge thereof. That is, the flat surface of the tongue 12*c* is formed so that an opening angle θ of a straight line that contacts the outer circumference of the impeller 20 at the most downstream portion and contacts the flat surface with respect to an inner surface of the exhaust port 12 at the anti-nose side is constant.

Figure 11:
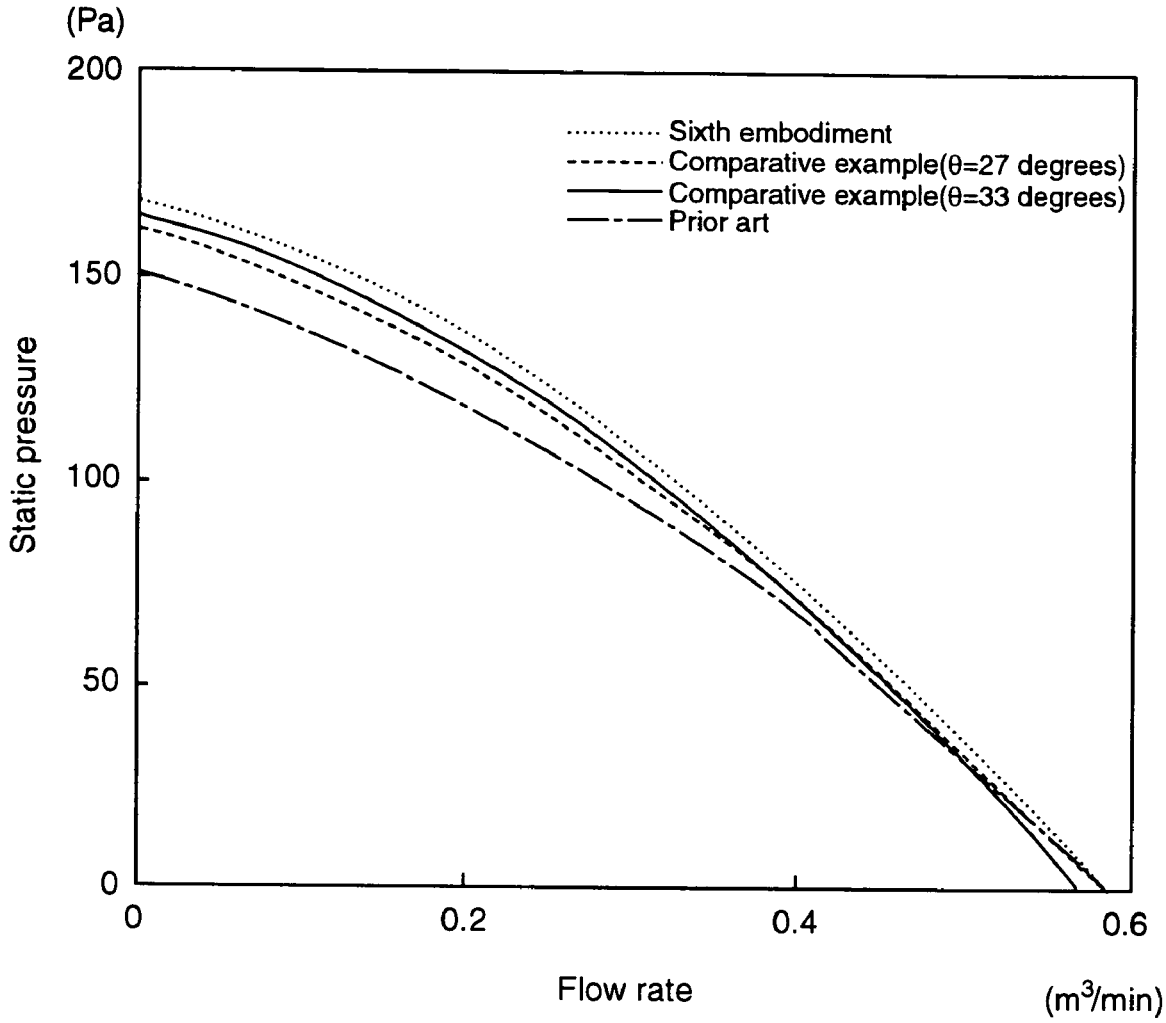
FIG. 11 is a graph that compares the performances of the sixth embodiment, the comparative example of FIG. 10, and the conventional example.
Figure 15:
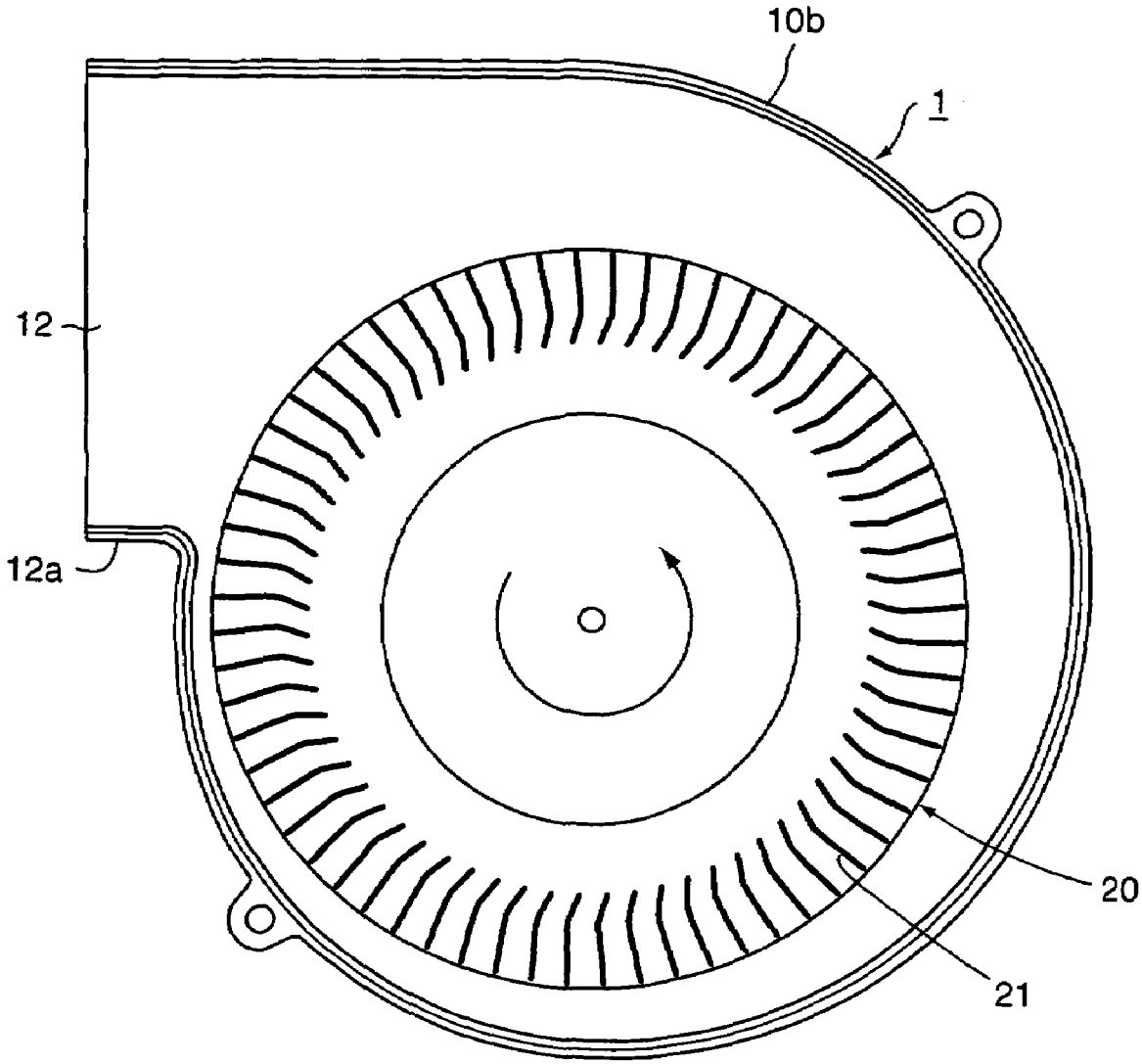
PRIOR ART FIG. 15
FIG. 15 is a front view of the centrifugal fan in FIG. 12 when one of two-part casings is removed.

FIG. 11 is a graph that shows the performance of the sixth embodiment having the tongue with the curved surface at the nose side in comparison with those of the comparative example having the tongue with the flat surface at the nose side when θ=27 degrees, the comparative example when θ=33 degrees, and the conventional example having no tongue at the nose side as shown in FIG. 15. The following table 1 shows values of the maximum static pressure and the maximum flow rate, which corresponds to a value of air quantity, represented in the graph of FIG. 11.

TABLE 1

| | Maximum static pressure (Pa) | Maximum flow rate ($m^3$/min) |
|---|---|---|
| Sixth embodiment | 168 | 0.59 |
| Comparative example (θ = 27 degrees) | 164 | 0.57 |
| Comparative example (θ = 33 degrees) | 161 | 0.59 |
| Prior art | 150 | 0.59 |

The values of the maximum flow rate are almost identical in any cases. However, the graph shows that the tongue 12*b* or 12*c* increases the maximum static pressure. Further, the graph shows that the curved surface of the tongue 12*b* of the sixth embodiment is effective to increase the maximum static pressure and the maximum flow rate as compared with the flat surface of the comparative example.

What is claimed is:

1. A centrifugal fan comprising:

a scroll casing that has an almost cylindrical shape including a first base wall, a second base wall, and a side circumferential wall, an air inlet that is opened in an axial direction being formed on a center portion of said first base wall, and an exhaust port that is opened in a circumferential direction being formed on one position of said side circumferential wall;

a motor that is attached to a center portion of said second base wall at the inside of said casing so that a rotating shaft of said motor is perpendicular to said second base wall;

a circuit board on which a control circuit for driving said motor is contained, said circuit board being supported at the position between said motor and said second base wall; and an impeller that is fixed to said rotating shaft, said impeller having many blades along the outer region thereof, wherein a cylindrical partition is formed on the inside of said second base wall over the entire circumference to jut toward said impeller, said partition consists of a high partition that has relatively large height in at least a region close to said exhaust port and a low partition that has relatively small height in the other region.

2. The centrifugal fan according to claim 1, wherein said high partition is formed at least within a first quadrant in a two-dimensional rectangular coordinate system that is defined in a plane perpendicular to a rotation axis of said motor, and wherein said first quadrant contains said exhaust port, second and fourth quadrants are located at both sides of said first quadrant, respectively, and a third quadrant is symmetric to said first quadrant with respect to the origin that is an intersection of said plane and said rotation axis.

3. The centrifugal fan according to claim 2, wherein said high partition is formed within said first quadrant and said low partition is formed within said second, third and fourth quadrants.

4. The centrifugal fan according to claim 2, wherein said high partition is formed within a region of 270 degrees at the maximum including at least a portion of said second and fourth quadrants in addition to said first quadrant.

5. The centrifugal fan according to claim 1, wherein the height of said low partition is designed not to be larger than 0.8 when the height of said high partition is assumed as 1.0.

6. The centrifugal fan according to claim 1, wherein the connecting portion between said high partition and said low partition is formed as a slope.

7. The centrifugal fan according to claim 1, wherein the connecting portion between said high partition and said low partition is formed as a vertical step.

8. A casing of a centrifugal fan having an almost cylindrical shape, comprising:

a first base wall on which an air inlet that is opened in an axial direction is formed at the center thereof;

a second base wall to which a motor that drives an impeller is fixed at the center thereof; and a side circumferential wall on which an exhaust port that is opened in a circumferential direction is formed at one portion, said side circumferential wall being formed so that the radius thereof gradually increases from an upstream to a downstream;

wherein a bell mouth is formed along the edge of said air inlet so as to jut toward the second base wall in the axial direction, and wherein said bell mouth is formed so that the inner diameter of said bell mouth gradually decreases in the axial direction from the outer surface of the casing to the middle portion of said bell mouth and gradually increases from said middle portion to the tip of said bell mouth; and wherein the cross section of the inner circumferential surface of said bell mouth from the outer surface of the casing to the middle portion of said bell mouth is a small arc having relatively small diameter, the cross section of the inner circumferential surface of said bell mouth from said middle portion to the tip of said bell mouth is a large arc having relatively large diameter, and said small arc and said large arc are connected.

9. A casing of a centrifugal fan having an almost cylindrical shape, comprising:

a first base wall on which an air inlet that is opened in an axial direction is formed at the center thereof;

a second base wall to which a motor that drives an impeller is fixed at the center thereof; and a side circumferential wall on which an exhaust port that is opened in a circumferential direction is formed at one portion, said side circumferential wall being formed so that the radius thereof gradually increases from an upstream to a downstream;

wherein a bell mouth is formed along the edge of said air inlet so as to jut toward the second base wall in the axial direction, and wherein said bell mouth is formed so that the inner diameter of said bell mouth gradually decreases in the axial direction from the outer surface of the casing to the middle portion of said bell mouth and gradually increases from said middle portion to the tip of said bell mouth; and wherein the cross section of the inner circumferential surface of said bell mouth from the outer surface of the casing to the middle portion of said bell mouth is an arc, the cross section of the inner circumferential surface of said bell mouth from said middle portion to the tip of said bell mouth is a straight line, and said arc and said straight line are connected.

10. A centrifugal fan comprising:

a scroll casing that has an almost cylindrical shape including a first base wall, a second base wall, and a side circumferential wall, an air inlet that is opened in an axial direction being formed on a center portion of said first base wall, and an exhaust port that is opened in a circumferential direction being formed on one position of said side circumferential wall;

an outer-rotor type motor that is attached to a center portion of said second base wall at the inside of said casing so that a rotating shaft of said motor is perpendicular to said second base wall; and a hub that is fixed to said rotating shaft, said hub holding a rotor of said motor and an impeller having many blades along the outer region thereof, wherein said hub is formed from high heat-conductivity material, and said hub has a tapered head so that a portion covering said motor becomes narrow toward said air inlet to have a curved cross section.

11. The centrifugal fan according to claim 10, wherein said casing is made from resin and has a molded-in bearing box to which a bearing that supports said rotating shaft is fixed.

12. A casing of a centrifugal fan having an almost cylindrical shape, comprising:

a first base wall on which an air inlet that is opened in an axial direction is formed at the center thereof;

a second base wall to which a motor that drives an impeller is fixed at the center thereof; and a side circumferential wall on which an exhaust port that is opened in a circumferential direction is formed at one portion, said side circumferential wall being formed so that the radius thereof gradually increases from an upstream to a downstream;

wherein said exhaust port has a tongue at a nose side that juts toward an anti-nose side so that said tongue narrows said exhaust port, and wherein said tongue has a curved surface in a direction of the discharge airflow so that the cross-sectional area of said exhaust port becomes wider toward the edge thereof.

13. The casing of a centrifugal fan according to claim 12, wherein said curved surface of said tongue is formed so that an opening angle of a straight line that contacts the outer circumference of said impeller at the most downstream portion and intersects said curved surface with respect to an inner surface of said exhaust port at the anti-nose side falls in a range from 24 degrees to 33 degrees.

14. A centrifugal fan as claimed in claim 1, wherein said partition closes an inner circumference edge of the impeller and said low partition is located in proximity with said circuit board.

* * * * *